US006179705B1

(12) United States Patent
Genge

(10) Patent No.: US 6,179,705 B1
(45) Date of Patent: Jan. 30, 2001

(54) ACCESSORY FOR EXHAUST GAS VENTS

(76) Inventor: Gary J. Genge, 4012 Kingston Court, Burlington, Ontario (CA), L7L 4Y5

( * ) Notice: Under 35 U.S.C. 154(b), the term of this patent shall be extended for 0 days.

(21) Appl. No.: 09/247,984

(22) Filed: Feb. 11, 1999

(51) Int. Cl.[7] ..... F23L 17/02
(52) U.S. Cl. ..... 454/38
(58) Field of Search ..... 454/35, 38

(56) References Cited

U.S. PATENT DOCUMENTS

| | | | | |
|---|---|---|---|---|
| 291,919 | * | 1/1884 | Matthews | 454/38 |
| 399,067 | * | 3/1889 | Nicholson | 454/38 |
| 1,328,647 | * | 1/1920 | Carl | 454/35 |
| 1,808,638 | * | 6/1931 | Coupard | 454/35 |
| 2,695,554 | * | 11/1954 | Jenson et al. | 454/35 |
| 2,764,972 | * | 10/1956 | Ryder | 454/35 |

* cited by examiner

*Primary Examiner*—Denise L. Ferensic
*Assistant Examiner*—Andrea M. Joyce

(57) ABSTRACT

A new accessory for combustion devices such as swimming pool heaters for preventing downdrafting and allowing for proper ventilation. The inventive device includes a vertically disposed pipe extending upwardly from a combustion device. The pipe has a generally cylindrical configuration. The pipe has an open upper end. The open upper end has a plurality of circumferentially spaced brackets extending upwardly therefrom. Upper ends of the brackets have an upper pipe extending upwardly therefrom. The upper pipe has open upper and lower ends. The open upper end of the upper pipe has a plurality of circumferentially spaced brackets extending outwardly therefrom. A draft hood is secured to the brackets of the vertically disposed pipe downwardly of the upper ends thereof. A vent cap is removably secured to upper ends of the brackets of the upper pipe.

7 Claims, 2 Drawing Sheets

Fig. 1
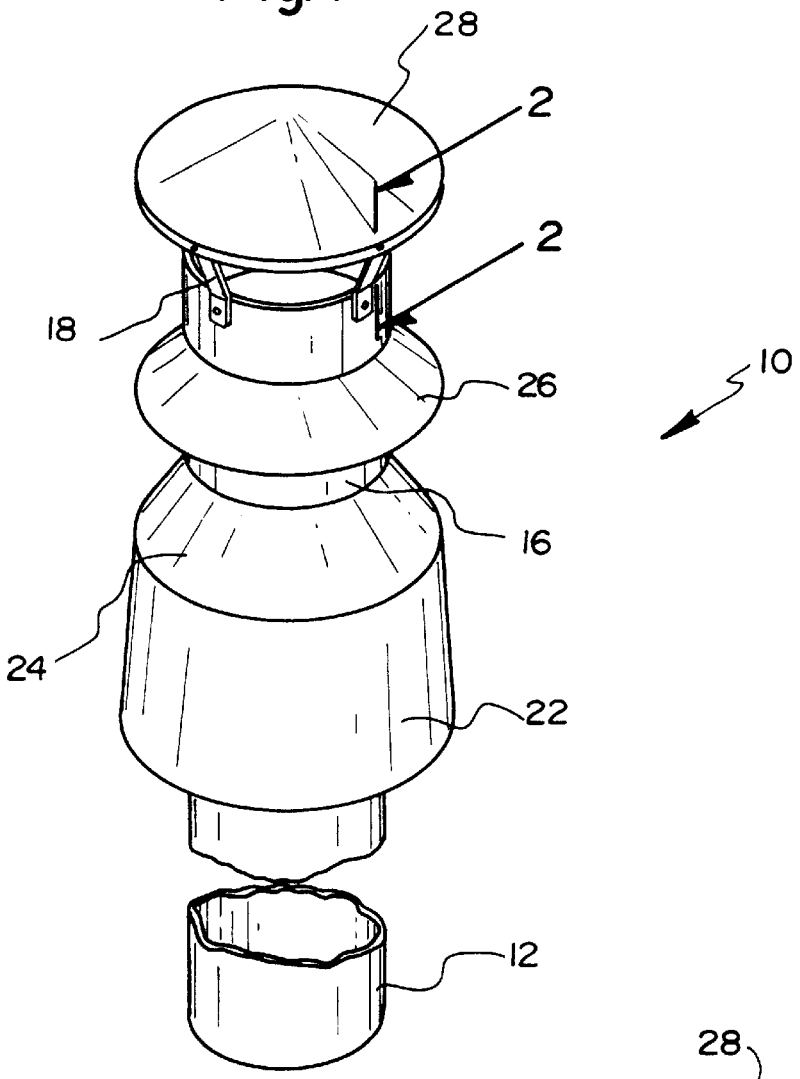
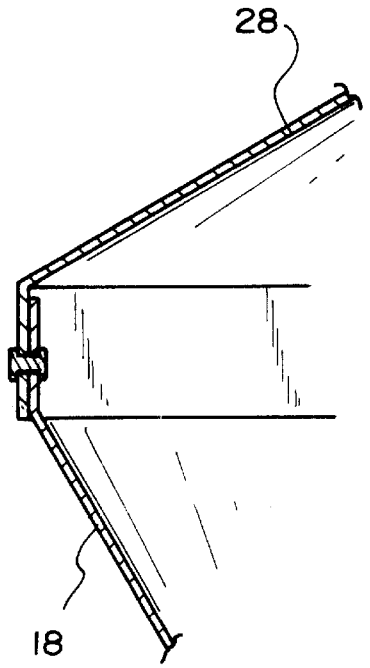
Fig. 2

ACCESSORY FOR EXHAUST GAS VENTS

BACKGROUND OF THE INVENTION

1. Field of the Invention

The present invention relates to roof vent covers and more particularly pertains to a new accessory for a combustion device such as a swimming pool heater for preventing downdrafting and allowing for proper ventilation.

2. Description of the Prior Art

The use of roof vent covers is known in the prior art. More specifically, roof vent covers heretofore devised and utilized are known to consist basically of familiar, expected and obvious structural configurations, notwithstanding the myriad of designs encompassed by the crowded prior art which have been developed for the fulfillment of countless objectives and requirements.

Known prior art roof vent covers include U. S. Pat. No. 4,580,548 to Ono; U.S. Pat. No. 5,005,328 to Holtgreve; U.S. Pat. No. 5,081,914 to Mejia; U.S. Pat. No. 4,759,270 to Lindeen; U.S. Pat. No. 5,402,611 to Vagedes; and U.S. Pat. No. Des. 277,028 to Waltz et al.

While these devices fulfill their respective, particular objectives and requirements, the aforementioned patents do not disclose a combustion device such as a new accessory for combustion devices such as a swimming pool heater. The inventive device includes a vertically disposed pipe extending upwardly from a combustion device such as a swimming pool heater. The pipe has a generally cylindrical configuration. The pipe has an open upper end. The open upper end has a plurality of circumferentially spaced brackets extending upwardly therefrom. Upper ends of the brackets have an upper pipe extending upwardly therefrom. The upper pipe has open upper and lower ends. The open upper end of the upper pipe has a plurality of circumferentially spaced brackets extending outwardly therefrom. A draft hood is secured to the brackets of the vertically disposed pipe downwardly of the upper ends thereof. A vent cap is removably secured to upper ends of the brackets of the upper pipe.

In these respects, the accessory for combustion devices such as swimming pool heaters according to the present invention substantially departs from the conventional concepts and designs of the prior art, and in so doing provides an apparatus primarily developed for the purpose of preventing downdrafting and allowing for proper ventilation.

SUMMARY OF THE INVENTION

In view of the foregoing disadvantages inherent in the known types of roof vent covers now present in the prior art, the present invention provides a new accessory for combustion devices such as swimming pool heaters construction wherein the same can be utilized for preventing downdrafting and allowing for proper ventilation.

The general purpose of the present invention, which will be described subsequently in greater detail, is to provide a new accessory for combustion devices such as swimming pool heaters apparatus and method which has many of the advantages of the roof vent covers mentioned heretofore and many novel features that result in a new accessory for combustion devices such as swimming pool heaters which is not anticipated, rendered obvious, suggested, or even implied by any of the prior art roof vent covers, either alone or in any combination thereof.

To attain this, the present invention generally comprises a vertically disposed pipe extending upwardly from a combustion device. The pipe has a generally cylindrical configuration. The pipe has an open upper end. The open upper end has a plurality of circumferentially spaced brackets extending upwardly therefrom. Upper ends of the brackets have an upper pipe extending upwardly therefrom. The upper pipe has open upper and lower ends. The open upper end of the upper pipe has a plurality of circumferentially spaced brackets extending outwardly therefrom. A draft hood is secured to the brackets of the vertically disposed pipe downwardly of the upper ends thereof. The draft hood includes a cylindrical body portion positioned over the vertically disposed pipe. The cylindrical body portion includes a tapered neck portion extending upwardly therefrom. An upper end of the tapered neck portion is secured to the bracket. A conical flange is secured around the upper pipe at a central portion thereof. A vent cap is removably secured to upper ends of the brackets of the upper pipe. The vent cap is disposed over the open upper end of the upper pipe. The vent cap has a generally dome shape.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new accessory for combustion devices such as swimming pool heaters apparatus and method which has many of the advantages of the roof vent covers mentioned heretofore and many novel features that result in a new accessory for combustion devices such as swimming pool heaters which is not anticipated, rendered obvious, suggested, or even implied by any of the prior art roof vent covers, either alone or in any combination thereof.

It is another object of the present invention to provide a new accessory for combustion devices such as swimming pool heaters which may be easily and efficiently manufactured and marketed.

It is a further object of the present invention to provide a new accessory for combustion devices such as swimming pool heaters which is of a durable and reliable construction.

An even further object of the present invention is to provide a new accessory for combustion devices such as swimming pool heaters which is susceptible of a low cost of manufacture with regard to both materials and labor, and which accordingly is then susceptible of low prices of sale to the consuming public, thereby making such accessory for combustion devices such as swimming pool heaters economically available to the buying public.

Still yet another object of the present invention is to provide a new accessory for combustion devices such as swimming pool heaters which provides in the apparatuses and methods of the prior art some of the advantages thereof, while simultaneously overcoming some of the disadvantages normally associated therewith.

Still another object of the present invention is to provide a new accessory for combustion devices such as swimming pool heaters for preventing downdrafting and allowing for proper ventilation.

Yet another object of the present invention is to provide a new accessory for combustion devices such as swimming pool heaters which includes a vertically disposed pipe extending upwardly from a combustion device. The pipe has a generally cylindrical configuration. The pipe has an open upper end. The open upper end has a plurality of circumferentially spaced brackets extending upwardly therefrom. Upper ends of the brackets have an upper pipe extending upwardly therefrom. The upper pipe has open upper and lower ends. The open upper end of the upper pipe has a plurality of circumferentially spaced brackets extending outwardly therefrom. A draft hood is secured to the brackets of the vertically disposed pipe downwardly of the upper ends thereof. A vent cap is removably secured to upper ends of the brackets of the upper pipe.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a perspective view of a new accessory for combustion devices according to the present invention.

FIG. 2 is a cross-sectional view of the present invention as taken along line 2—2 of FIG. 1.

DESCRIPTION OF THE PREFERRED EMBODIMENT

Figure 4:
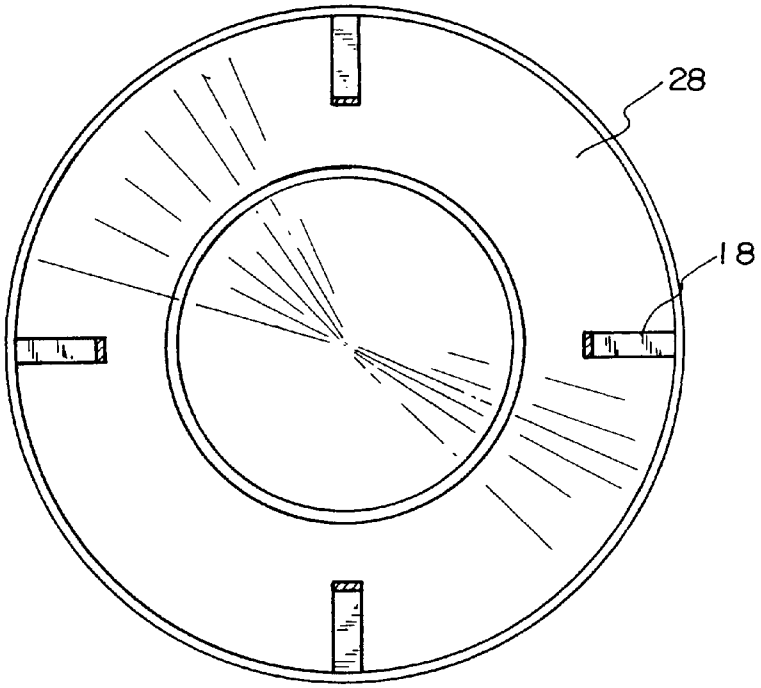
FIG. 4 is a cross-sectional view of the present invention as taken along line 4—4 of FIG. 3.
Figure 3:
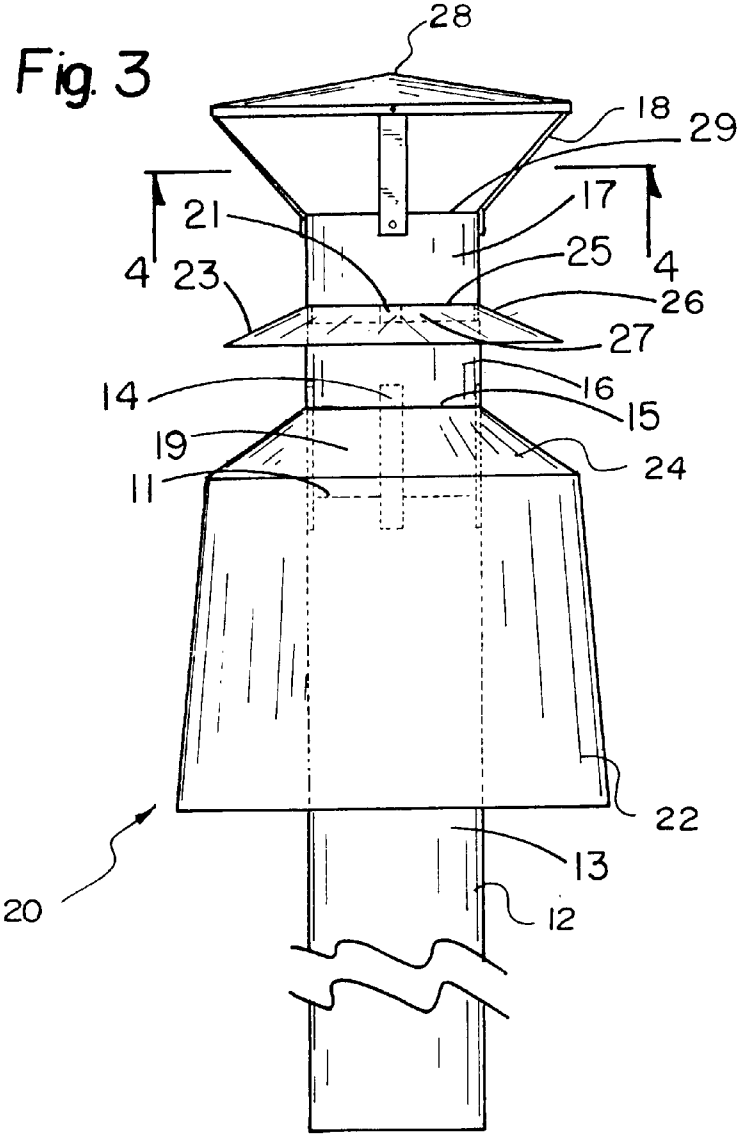
FIG. 3 is a front elevation view of the present invention.

With reference now to the drawings, and in particular to FIGS. 1 through 4 thereof, a new accessory for combustion devices such as swimming pool heaters embodying the principles and concepts of the present invention and generally designated by the reference numeral 10 will be described.

As best illustrated in FIGS. 1 through 4, the accessory for combustion devices 10 comprises a vertically disposed pipe 12 extending upwardly from a combustion device. The pipe 12 has a generally cylindrical configuration. The vent pipe 12 has a plurality of axially-aligned segments including a lower pipe segment 13, a medial pipe segment 16, and an upper pipe segment 17. A vent gap is formed between each of the pipe segments. A first spacer member 14 (such as at least one bracket) is mounted on and extends between the open upper end 11 of the lower pipe segment 13 and the open lower end 15 of the medial pipe segment 16 in a manner producing a first vent gap 19 between the open upper end of the lower pipe segment and the open lower end of the medial pipe segment. A second spacer member 21 is mounted on and extends between the open upper end 23 of the medial pipe segment 16 and the open lower end 15 of the upper pipe segment 17 in a manner producing a second vent gap 27 between the open upper end of the medial pipe segment and the open lower end of the upper pipe segment. The open upper end 29 of the upper pipe segment 17 has a third spacer member 18 (such as at least one bracket) extending upwardly therefrom.

A draft hood 20 is secured to the brackets 14 of the vertically disposed pipe 12 downwardly of the upper ends thereof. The draft hood 20 includes a cylindrical body portion 22 positioned over the vertically disposed pipe 12. The cylindrical body portion 22 includes a tapered neck portion 24 extending upwardly therefrom. An upper end of the tapered neck portion 24 is secured to the brackets 14. The draft hood 20 would serve to prevent downdrafting into the combustion device.

A conical flange 26 is secured around the medial pipe segment 16 at a central portion thereof.

A vent cap 28 is removably secured to upper ends of the brackets 18 of the medial pipe segment 16. The vent cap 28 is disposed over the open upper end of the medial pipe segment 16. The vent cap 28 has a generally dome shape. The vent cap 28 would protect the combustion device from rain and other inclement weather.

In use, the present invention would stop downdrafting and allow for proper ventilation. The combustion devices could include, but will not be limited to, swimming pool heaters and commercial and residential heating boilers. The device 10 would draw heat combustion away and also protect the heater from rain. The vent cap 28 can be removed when used on indoor systems.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An accessory for venting combustion devices for preventing downdrafting and allowing for proper ventilation comprising, in combination:

a vertically disposed vent pipe for extending upwardly from a combustion device, the vent pipe having a generally cylindrical configuration with an interior, the vent pipe having a plurality of axially-aligned segments including a lower pipe segment, a medial pipe segment, and an upper pipe segment, a vent gap being formed between each of the pipe segments, each of the pipe segments having an open upper end and an open lower end, the open upper end of the lower pipe segment having a plurality of circumferentially spaced lower brackets extending upwardly therefrom, the open lower end of the medial pipe segment being mounted on upper ends of the lower brackets to produce a gap between the open upper end of the lower pipe segment and the open lower end of the medial pipe segment to form a first vent gap, the open upper end of the medial pipe segment having a plurality of circumferentially spaced medial brackets extending upwardly therefrom, the open lower end of the upper pipe segment being mounted on upper ends of the medial brackets to produce a gap between the open upper end of the medial pipe segment and the open lower end of the upper pipe segment to form a second vent gap, the open upper end of the upper pipe segment having a plurality of circumferentially spaced upper brackets extending upwardly therefrom;

a draft hood secured around the open lower end of the medial pipe segment to locate an upper end of the draft hood above the first vent gap, the draft hood including a frusto-conical body portion extending downwardly about the lower pipe segment, the draft hood including a frusto-conical neck portion extending between the medial pipe segment and the body portion of the draft hood, an upper end of the neck portion being secured to the medial pipe segment, the draft hood being adapted to permit air to enter the first vent gap into the interior of the vent pipe without disturbance from a horizontally moving draft;

a frusto-conical annular flange secured around the upper pipe segment at the open lower end of the upper pipe segment to locate the annular flange above the second vent gap; and a vent cap removably secured to upper ends of the upper brackets of the upper pipe segment for diverting precipitation from entering the open upper end of the upper pipe segment, the vent cap being disposed over the open upper end of the upper pipe segment to produce a gap between the vent cap and the open upper end of the upper pipe segment to form a third vent gap for permitting exhaust gases to exit the vent pipe, the vent cap having a generally domed shape.

2. An accessory for combustion devices for preventing downdrafting and allowing for proper ventilation comprising:

a vent pipe for extending upwardly from a combustion device, the vent pipe having a tubular configuration with an interior, the vent pipe having a plurality of axially-aligned segments including a lower pipe segment, a medial pipe segment, and an upper pipe segment, a vent gap being formed between each of the pipe segments, each of the pipe segments having an open upper end and an open lower end, a first spacer member mounted on and extending between the open upper end of the lower pipe segment and the open lower end of the medial pipe segment in a manner producing a first of the vent gaps between the open upper end of the lower pipe segment and the open lower end of the medial pipe segment, a second spacer member mounted on and extending between the open upper end of the medial pipe segment and the open lower end of the upper pipe segment in a manner producing a second of the vent gaps between the open upper end of the medial pipe segment and the open lower end of the upper pipe segment, the open upper end of the upper pipe segment having a third spacer member extending upwardly therefrom;

a draft hood secured to the medial pipe segment and extending downwardly about the first vent gap;

a vent cap removably secured to an upper end of the third spacer member mounted on the upper pipe segment to form a third gap between the vent cap and the open upper end of the upper pipe segment.

3. The accessory for combustion devices as set forth in claim 2 wherein the draft hood includes a body portion positioned over the lower pipe segment, a tapering neck portion extending upwardly from the body portion, an upper end of the tapering neck portion being secured to the medial pipe segment.

4. The accessory for combustion devices as set forth in claim 2 and further including a frusto-conical flange secured around the upper pipe segment and depending over the second vent gap.

5. The accessory for combustion devices as set forth in claim 2 wherein the vent cap is disposed over the open upper end of the upper pipe segment, the vent cap having a domed shape.

6. An accessory for venting combustion devices to reduce downdrafting and allowing for proper ventilation comprising:

a vent pipe for extending upwardly from a combustion device, the vent pipe having a tubular configuration with an interior, the vent pipe having a plurality of axially-aligned segments including a lower pipe segment, a medial pipe segment, and an upper pipe segment, a vent gap being formed between each of the pipe segments, each of the pipe segments having an open upper end and an open lower end, a first spacer member mounted on and extending between the open upper end of the lower pipe segment and the open lower end of the medial pipe segment in a manner producing a first of the vent gaps between the open upper end of the lower pipe segment and the open lower end of the medial pipe segment, a second spacer member mounted on and extending between the open upper end of the medial pipe segment and the open lower end of the upper pipe segment in a manner producing a second of the vent gaps between the open upper end of the medial pipe segment and the open lower end of the upper pipe segment, the open upper end of the upper pipe segment having a third spacer member extending upwardly therefrom;

a draft hood mounted about the open lower end of the medial pipe segment such that an upper end of the draft hood is located above the first vent gap, the draft hood including a body portion extending downwardly about the first vent gap and the lower pipe segment, a circumferential wall defining the body portion being oriented parallel to a perimeter wall of the lower pipe segment, the draft hood having a neck portion extending between the medial pipe segment and the body portion of the draft hood, the neck portion having a frusto-conical shape, the draft hood being adapted to permit air to enter the first vent gap into the interior of the vent pipe without disturbance from a horizontally moving draft;

a frusto-conical annular flange secured around the upper pipe segment at the open lower end of the upper pipe segment such that the annular flange extends outwardly from the second vent gap; and a vent cap removably secured to the third spacer member for diverting precipitation from entering the open upper end of the upper pipe segment, the vent cap being disposed over the open upper end of the upper pipe segment to produce a third vent gap between the vent cap and the open upper end of the upper pipe segment for permitting exhaust gases to exit the vent pipe.

7. The accessory of claim 6 wherein each of the vent gaps extends along the entire circumference of the vent pipe.

* * * * *